US006560818B1

(12) United States Patent
Hasko

(10) Patent No.: US 6,560,818 B1
(45) Date of Patent: May 13, 2003

(54) CARPET CLEANING WAND BOOT

(75) Inventor: John M. Hasko, Klamath Falls, OR (US)

(73) Assignee: Production Metal Forming, Inc., Klamath Falls, OR (US)

( * ) Notice: Subject to any disclaimer, the term of this patent is extended or adjusted under 35 U.S.C. 154(b) by 33 days.

(21) Appl. No.: 09/680,025

(22) Filed: Oct. 5, 2000

Related U.S. Application Data

(60) Provisional application No. 60/158,657, filed on Oct. 8, 1999.

(51) Int. Cl.[7] ..... A47L 9/02
(52) U.S. Cl. ..... 15/321; 15/393
(58) Field of Search ..... 15/320, 321, 322, 15/393

(56) References Cited

U.S. PATENT DOCUMENTS 1,068,713 A * 7/1913 Thurman ..... 15/393
3,909,197 A * 9/1975 Cremers ..... 15/321
3,958,298 A * 5/1976 Cannan ..... 15/322
4,095,309 A * 6/1978 Sundheim ..... 15/320
4,158,248 A * 6/1979 Palmer ..... 15/321
4,270,238 A * 6/1981 Shallenberg et al. ..... 15/321
5,075,920 A * 12/1991 Salmon ..... 15/302
5,485,652 A * 1/1996 Holland ..... 15/322
5,867,861 A * 2/1999 Kasen et al. ..... 15/320

* cited by examiner

*Primary Examiner*—Chris K. Moore
(74) *Attorney, Agent, or Firm*—Dority & Manning, P.A.

(57) ABSTRACT

A molded component or boot is removably fitted to the narrow edges of a commercial carpet cleaning wand otherwise in contact with carpet to be cleaned. Wider bearing surfaces of the attachment or boot allow for smoother action of the carpet cleaning wand over the carpet, without skip or chatter due to directional nap, such as associated with short nap carpets (e.g., berbers or indoor/outdoor carpet). Functional life of the carpet cleaning wand is extended indefinitely through removal and replacement of the attachment. Screw mounting or other simple removable elements facilitate rapid field service. Lightweight molded plastic contributes to ergonomic aspects without impeding any "spray down" or vacuum functions of the wand.

30 Claims, 5 Drawing Sheets

CARPET CLEANING WAND BOOT

PRIORITY CLAIM

Priority is hereby claimed to prior filed provisional application with the same title and same indicated inventorship as presently presented, filed on Oct. 8, 1999 and assigned U.S. Ser. No. 60/158,657.

BACKGROUND OF THE INVENTION

The present invention relates to improved carpet cleaning operations generally and specifically to improved carpet cleaning wand performance and durability.

Commercial carpet cleaning equipment involves typically heavier gauge devices. For example, a main vacuum rod or wand may generally be made of metal, such as stainless steel, to prevent rust or other deterioration based on contact with water or cleaning chemicals. Such a carpet cleaning wand may, for example, have two separate hose arrangements, one for applying a cleaning liquid (cleaning chemicals, water, combinations of both, etc.), and a return vacuum hose for vacuuming dirt, debris and/or liquids.

A typical metal commercial carpet cleaning wand will have a head portion intended for contact with the floor surface (generally carpet) to be cleaned. Such wand head may have two separate sections for being respectively associated with the two respective hoses (liquid and vacuum) as referenced above. In other words, in one wand head section, various liquid components will be "sprayed down" onto the surface to be cleaned. Another wand head section may constitute a vacuum nozzle. Each wand head section is respectfully connected to, or associated with, its respective function. For example, the suction nozzle is directly associated with the vacuum hose and the "spray down" area is associated with one or more spray nozzles or ports associated with the liquid hose or line. Such liquid hose or line may itself be of metal construction, such as stainless steel, to prevent rust or other deterioration. The stem of the wand may constitute a rigid portion of the vacuum hose. As a central body or chassis member of the wand, a heavier gauge material is often used for such rigid vacuum hose portion.

The foregoing conventional arrangement collectively makes for an object of significant weight. In addition, a trigger control may be mounted on the wand for selective manual operation of spraying cleaning liquids or the like, adding to the weight and heft of the object. An adjustable handle may be mounted along the wand body (or rigid vacuum hose portion) to help with manipulation of the wand. The wand may also have a curved upper handle portion for improved handling.

The vacuum hose and liquid hose/line are connected with vacuum and spray power equipment, as well understood by those of ordinary skill in the art, without additional discussion. The details of such features form no particular parts of the subject invention.

During use, the carpet cleaning wand is often pulled or drawn towards the user, who backs along a section of floor covering to be cleaned. Such an action causes a particular area to be first sprayed (if at all) with a liquid and then immediately subjected to the applied vacuum force. Alternatively, the wand may be moved in other directions, such as "forward", or back and forth or side to side or combinations.

At its interface with the floor covering surface to be cleaned, the head of the typical carpet cleaning wand has fairly narrow walled surfaces defining the vacuum nozzle and "spray down" regions thereof. Such narrow walls are structurally adequate due to the strength of the metal, and at the same time are relatively thin to help minimize weight and cost. However, one result of such typical construction is that very narrow almost blade-like edges are presented for contact with the floor covering surface to be cleaned. This results in potential skip or chatter across the floor covering as the narrow bottom edges of the carpet cleaning wand are drawn or otherwise moved across the floor covering surface. The performance of the wand, and hence the carpet cleaning system, is diminished as the wand tends to want to skip or chatter across the carpet in such fashion.

The above referenced performance degradation is particularly prevalent with relatively shorter nap carpets, for example, berbers, or indoor/outdoor carpets or the like. Such exemplary short nap carpets tend to have a definite directional nap. Thus, the relatively narrow surface edges of a conventional carpet cleaning wand head in contact with such short nap carpets tend to want to skip or chatter across the carpet, depending on which way the wand head is being pulled or pushed relative to the nap.

Performance degradation as referenced above may manifest itself in different forms. First, spray and/or vacuum operations may be less than optimum. "Marking" on the floor covering surface (simply meaning the "combed" pattern of the floor covering nap), may take the form of multiple parallel lines appearing in varying degrees in the resulting path of the wand.

Such chatter or skip can induce excessive wand head wear, even in a metal object. As wear occurs, performance tends to lessen, and eventually the entire wand as an integral unit must be replaced simply to address damage and/or wear to the floor-contacting head portion.

Another aspect of degraded performance is the adverse ergonomic component of working with equipment which introduces vibrations during movement. In other words, vibrations from the wand head are transmitted along the rigid wand to the wand operator. Someone operating such equipment on a full time basis, or for at least hours at a time can tend to ergonomically feel affects from even mild vibrations, when so consistently repeated.

SUMMARY OF THE INVENTION

The present invention recognizes and addresses various of the foregoing problems, and others, concerning carpet cleaning operations. Thus, broadly speaking, a principal object of this invention is improved carpet cleaning operations. More particularly, a main concern is improved carpet cleaning wand performance and durability, especially for commercial carpet cleaning systems.

It is therefore another particular object of the present invention to provide an improved carpet cleaning system having an improved carpet cleaning wand. Another more specific object is to provide an improved carpet cleaning wand head which has smoother operation, with less vibration while being translated over the floor covering surface to be cleaned.

Another general object of the present invention is to provide an apparatus, the functional principles of which are adaptable to a wide range of conventional carpet cleaning wand configurations, for improved performance and durability thereof.

Still a further more particular object is to provide an improved attachment apparatus for conventional carpet cleaning wands, which is lightweight for ease of use and removable for ease of service.

Another present object is to provide a commercial carpet cleaning wand head attachment which presents a wider bearing surface against the floor coverings to be cleaned, for allowing easier motion of the carpet cleaning wand relative to such surfaces. It is another more particular object to allow the life of the conventional carpet cleaning wand to be extended indefinitely by replacement of such attachment, to prevent edges of the conventional carpet cleaning wand from wearing out. A still further more particular object is to provide such an improved attachment which may be quickly and easily replaced, even in the field, to greatly minimize any downtime for the associated carpet cleaning system.

Additional objects and advantages of the invention are set forth in, or will be apparent to those of ordinary skill in the art from, the detailed description herein. Also, it should be further appreciated that modifications and variations to the specifically illustrated, referenced and discussed features or materials and devices hereof may be practiced in various embodiments and uses of this invention without departing from the spirit and scope thereof, by virtue of present reference thereto. Such variations may include, but are not limited to, substitution of equivalent means and features or materials for those shown, referenced or discussed, and the functional, operational or positional reversal of various parts, features, or the like.

Still further, it is to be understood that different embodiments, as well as different presently preferred embodiments, of this invention may include various combinations or configurations of presently disclosed features, elements, or their equivalents (including combinations of features or configurations thereof not expressly shown in the figures or stated in the detailed description).

One exemplary embodiment of the present invention relates to an improved carpet cleaning wand head attachment or boot for smoother operation through wider bearing surfaces on the carpet to be cleaned, without impeding functions of the carpet cleaning wand in any way. Such attachment or boot is preferably removable and replaceable for wand durability and for rapid servicing. It may also comprise a molded component, such as a plastic material, in order to be of desired shape and relatively lightweight.

Another present exemplary embodiment concerns a collective carpet cleaning system incorporating a carpet cleaning wand having such an improved attachment. Such attachment may be integrally incorporated with a wand head manufactured for association therewith, or may be secured to a wand head modified, as needed, for receipt of such attachment. In such embodiment, a conventional wand head may have added screw holes for securement (for example) by screws of an attachment molded or shaped to securely interface or seat on the relatively narrow floor-contacting surfaces of the bottom of the conventional carpet cleaning wand. In such an arrangement, the attachment may have respective openings for corresponding use and association with the vacuum nozzle area and "spray down" regions of the conventional wand head.

Those of ordinary skill in the art will better appreciate the features and aspects of such embodiments and others, upon review of the remainder of the specification.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
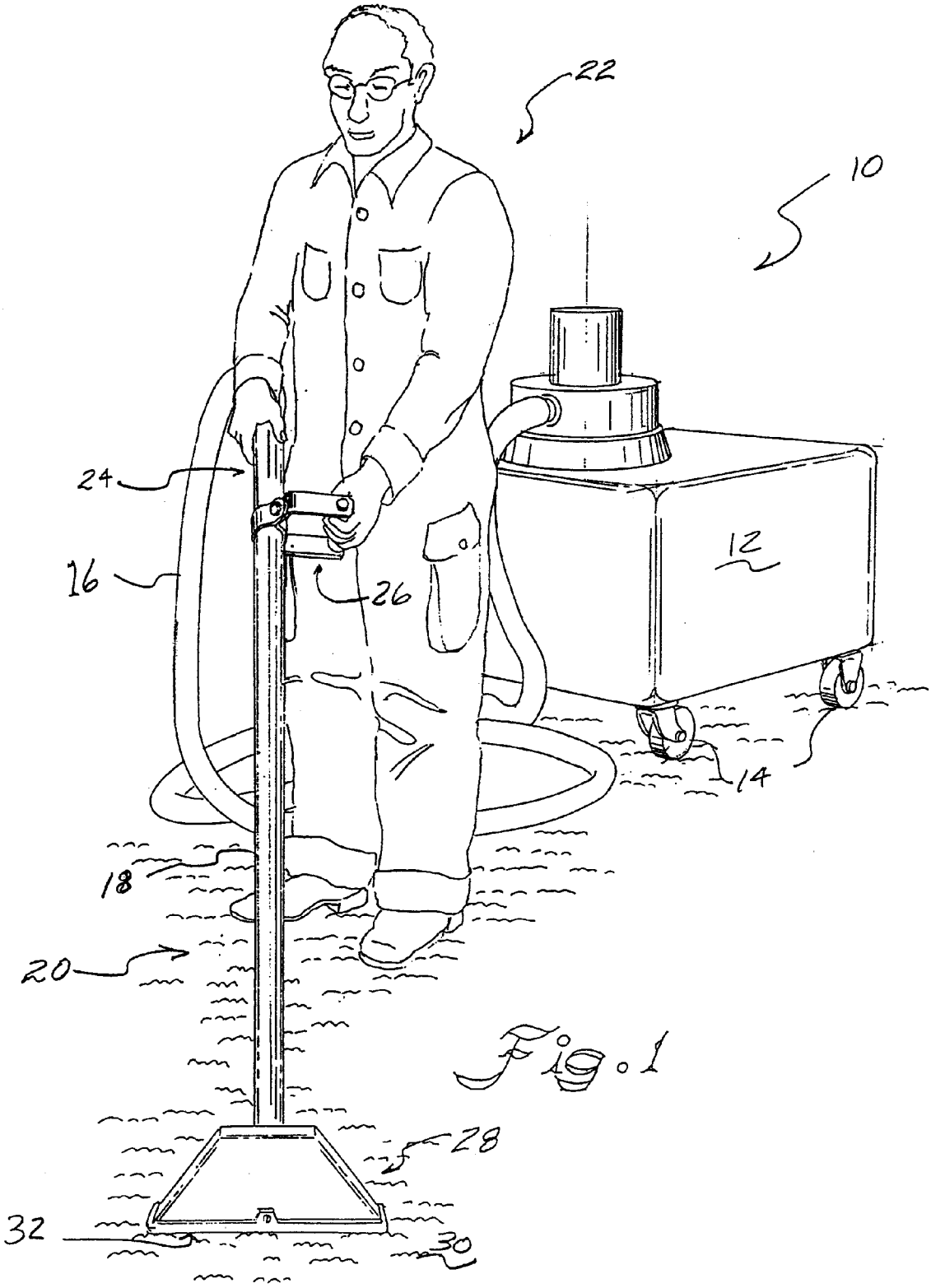
FIG. 1 is a perspective view of an exemplary intended overall embodiment and carpet cleaning system configuration during use of the subject invention.

Repeat use of reference characters throughout the present specification and appended drawings is intended to represent same or analogous features or elements of the invention.

DETAILED DESCRIPTION OF THE PREFERRED EMBODIMENTS

FIG. 1 illustrates a perspective view of an exemplary intended overall environment for practice of the subject invention. In general, a commercial carpet cleaning system generally 10 as represented includes a mobile or base unit 12 which is movable, such as through use of rollers 14 or their equivalents. The mobile unit 12 produces vacuum pressure as applied through a vacuum hose generally 16. A rigid or metal portion generally 18 of such vacuum hose doubles as a main body (i.e., chassis) and handle for carpet cleaning wand generally 20.

An operator 22 may manipulate wand 20, such as by grasping at a handle end portion generally 24 and/or an adjustable handle attachment generally 26, as well understood by those of ordinary skill in the art without discussing additional details thereof. By manipulating handle end 24 and adjustable handle attachment 26, operator 22 may traverse the wand head generally 28 over floor covering surface generally 30 to be cleaned.

In the present exemplary illustration, an attachment boot generally 32 in accordance with the subject invention may be associated with the wand head 28, for direct contact with floor covering surface 30, interposed between such surface 30 and wand head 28. As discussed hereinbelow, the addition and presence of attachment boot 32 improves performance and durability of wand 20, and therefore generally overall improves that of the carpet cleaning system 10, too.

As well understood by those of ordinary skill in the art without additional disclosure, a fluid or spraying line may be associated with wand 20, such that desired fluids (such as cleaning fluids and/or water) may be directed from mobile unit 12 through an appropriate fluid line, along rigid portion 18, and into wand head 28 for selected application onto floor covering surface 30. Such line may typically traverse along a "backside" of wand 20, and as such is not visible in the generally frontside perspective view of wand 20 as shown in present FIG. 1.

Also, in some embodiments, such fluid line (not shown) may interconnect between wand 20 and mobile unit 12 internally of vacuum hose 16, or external thereto (also not illustrated, but well known to those of ordinary skill in the art). The specific details of such hose interconnections form no particular aspect of the subject invention, though embodiments of the present invention do involve combinations of attachment boot 32 with carpet cleaning wands 20 as used in conjunction with commercial carpet cleaning systems, such as exemplary system 10. It is to be understood by those of ordinary skill in the art that variations may be practiced. For example, system 10 may incorporate a truck-mounted cleaning unit (vacuum and fluid handling) in place of the mobile unit 12, as illustrated. In such an arrangement, as well understood by those of ordinary skill in the art, the interconnecting hoses are simply run over further extensions, between wand 20 and the truck-mounted cleaning unit. All such variations are intended to come within the spirit and scope of the present invention.

Figure 2:
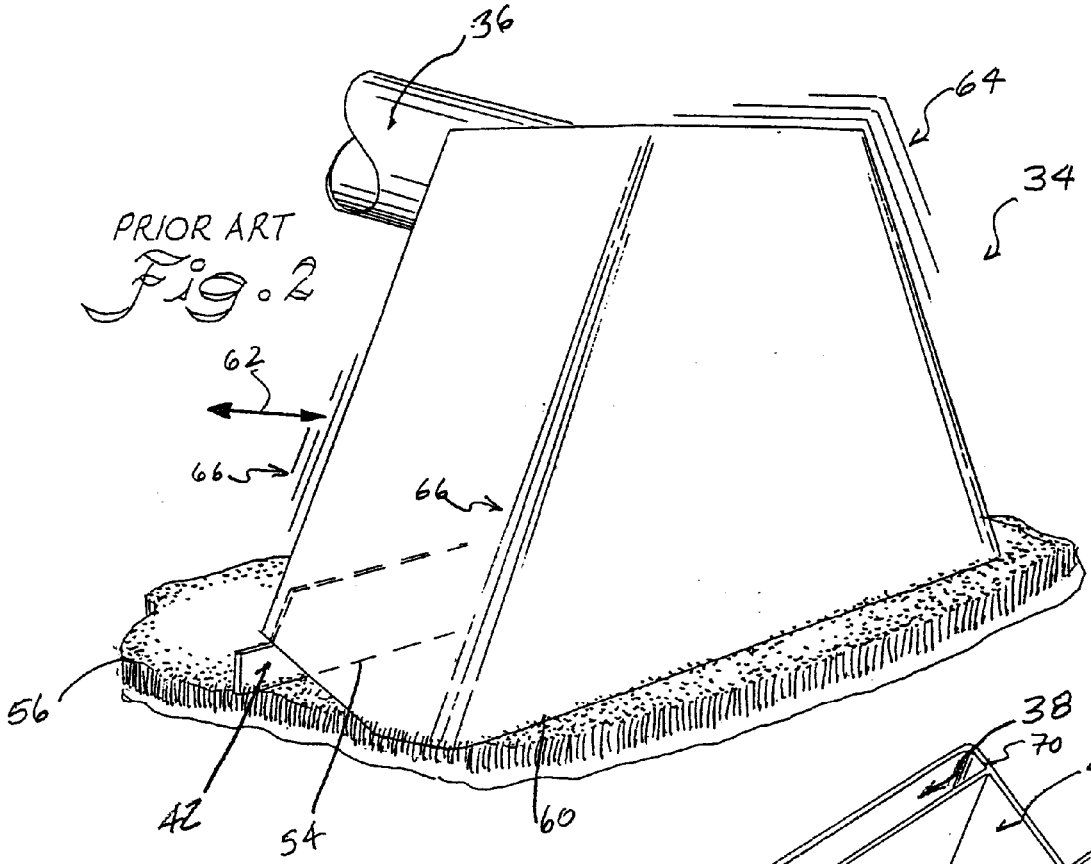
PRIOR ART Fig. 2
FIG. 2 is a generally front and right side elevational view of an exemplary conventional carpet cleaning wand head (marked "PRIOR ART") without incorporation of the subject invention.

FIG. 2 illustrates a generally front and right side elevational view of an exemplary conventional carpet cleaning wand head ("PRIOR ART") generally 34. Such wand head 34 is different from wand head 28 in that it has not been modified in accordance with the subject invention for use with attachment boot 32 as illustrated in FIG. 1.

Figure 3:
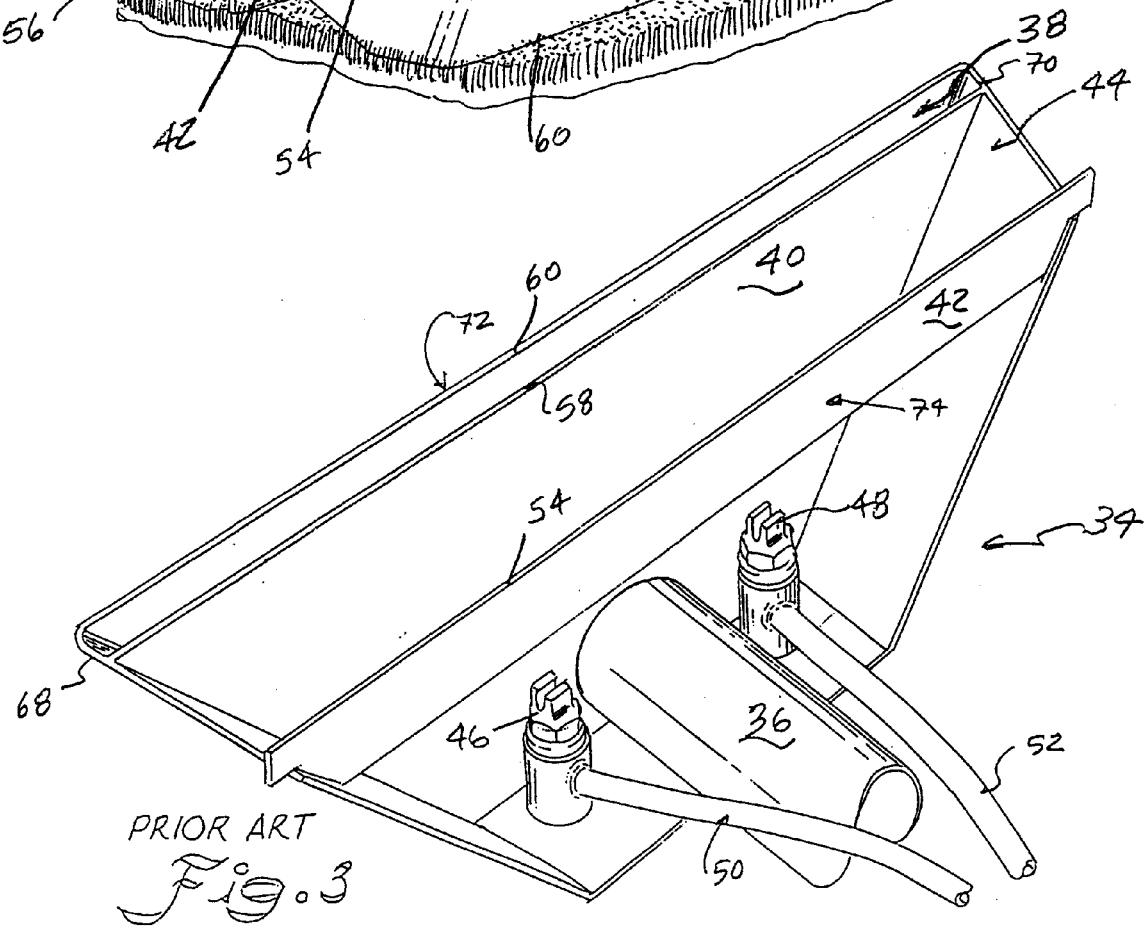
PRIOR ART Fig. 3
FIG. 3 is a generally bottom perspective view of the FIG. 2 exemplary conventional carpet cleaning wand head (also marked "PRIOR ART")

FIG. 3 illustrates a generally bottom and perspective view of the FIG. 2 conventional ("PRIOR ART") wand head 34 (again, not modified in accordance with the subject invention for association with attachment boot 32).

Collectively, FIGS. 2 and 3 illustrate that conventional wand head 34 has a rigid vacuum hose portion generally 36 which may double as a body for the wand to which head 34 is attached. Rigid vacuum hose 36 terminates into a vacuum nozzle or return generally 38. Opposing parallel surfaces generally 40 and 42 define a "spray down" region generally 44 into which fluid is selectively sprayed, such as through use of a manually operated trigger, actuated by operator 22 (FIG. 1). Such trigger is not seen in FIG. 1 due to a typical rear-mounted position thereof. Fluids such as cleaning fluids and/or water (possibly temperature controlled) are applied in such "spray down" region through use of spray nozzles 46 and 48, which in turn are fed by respective hoses 50 and 52, which are split from a primary fluid feeding hose, not shown in FIG. 3.

FIG. 2 illustrates the position of surface 42 in partial dotted line, to illustrate its continuing interaction as an edge surface generally 54 with the nap of exemplary carpet 56 across the width of wand head 34. Conventional wand head 34 defines other edge surfaces generally 58 and 60 (see FIG. 3), which also contact the nap of carpet 56.

As represented particularly in present FIG. 2, movement of wand head 34 back and forth along the generally axial direction 62 can result in chatter or bounce or skip across carpet surface 56 (see shudder lines generally 64 and 66). Such condition particularly occurs for carpets 56 having shorter naps, such as berber type carpets or indoor/outdoor carpets. Shorter nap carpets tend to have more defined directional naps. The skip or chatter of edge surfaces 54, 58 and 60 across such shorter nap carpets is particularly prevalent whenever such surfaces are drug or directed "against the grain" of the shorter nap. Such condition can lead to reduced effectiveness in performance, and excessive wear on the equipment (potentially resulting in the requirement that the entire wand be replaced). Also, such repetitive conditions can adversely impact ergonomic factors, resulting for example in excessive operator fatigue or other adverse consequences.

Dimensional dynamics of conventional wand head generally 34 and its associated wand (all of metal construction, such as stainless steel) relate also to the above-referenced chatter or skip problems, For example, the entire wand length may be approximately five feet, with the width of conventional wand head 34 about 12 inches between sides 68 and 70 thereof, and in a range from about 2 to 2½ inches deep between the front and back 72 and 74 thereof. Such dimensions may vary from one construction to another. Also, the referenced exemplary dimensions of wand head 34 are in relation to the vacuum nozzle area 38 and "spray down" region 44 thereof.

Also of importance is the general dimensions of edge surfaces 54, 58, and 60, in terms of thickness, especially relative to a direction perpendicular thereto (i.e., along the generally axial movement line 62). In such direction of width (perpendicular to axial arrow 62), the edge surfaces 54, 58 and 60 may typically be about 1/16 of an inch or even down to 1/32 of an inch. Such very narrow cleaning edges or edge surfaces in contact with carpet surfaces, particularly shorter nap carpets, results in the above-referenced problems in performance and durability.

Figure 4A:
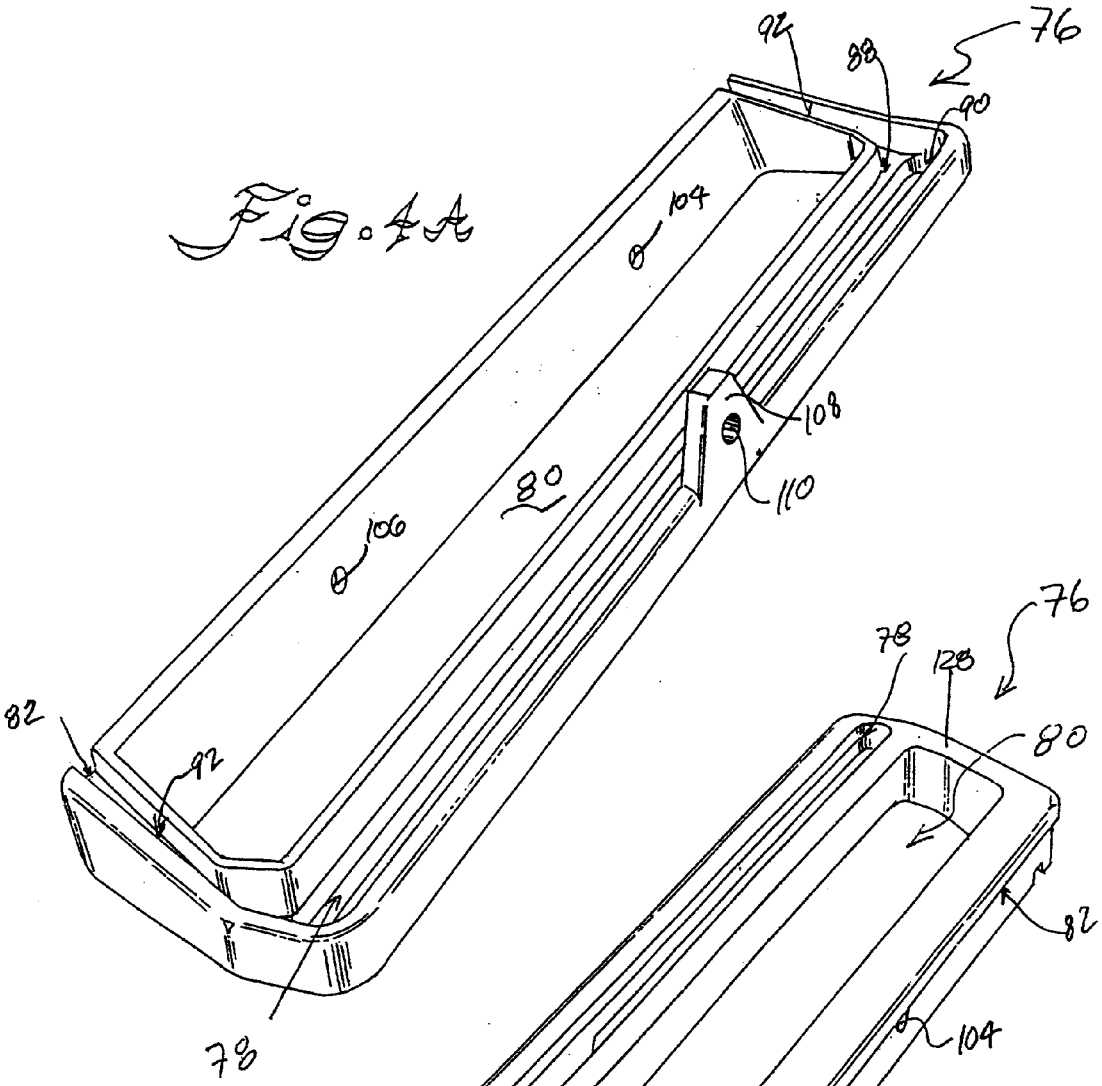
FIG. 4A is a generally top perspective view, from one side end, of a boot or attachment in accordance with the subject invention, shown from the side which is intended to mate with a wand head or end.
Figure 4B:
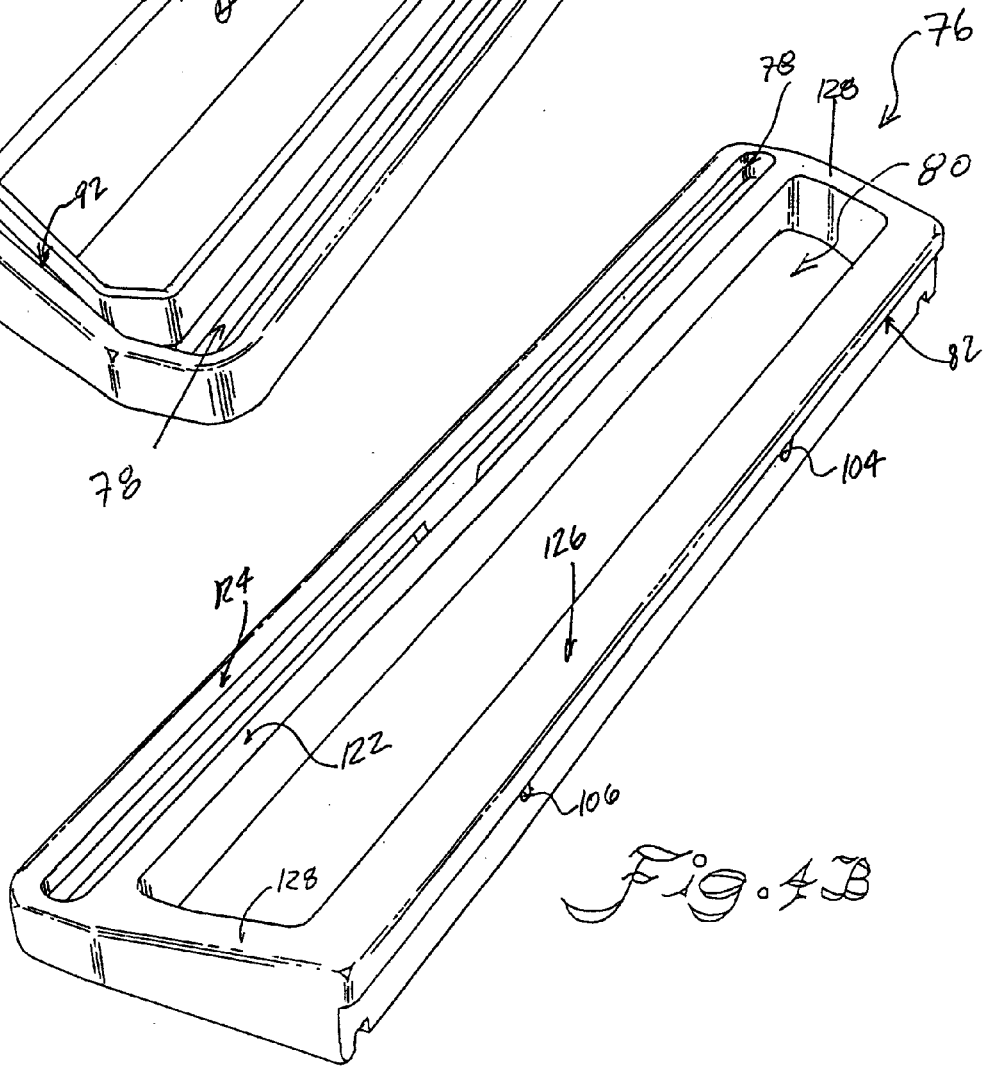
FIG. 4B is a generally bottom perspective view of the exemplary embodiment of the present invention of 4A, showing in detail the improved surface thereof for intended contact with a floor covering (i.e., carpet) to be cleaned.

FIG. 4A illustrates a device generally 76 in accordance with the subject invention, representing a top perspective view thereof (generally from one end) as it would mate to a wand head or end. FIG. 4B illustrates a bottom perspective view of such device 76, as it would interface with a carpet or floor covering surface to be cleaned.

Device 76 constitutes an attachment boot, such as device 32 secured to a wand head 28 as represented in present FIG. 1. As collectively illustrated in FIGS. 4A and 4B, such boot 76 forms its own respective vacuum nozzle region 78 and "spray down" area 80 for respectively corresponding with regions on a wand head such as vacuum nozzle 38 and "spray down" area 44 as illustrated in present FIG. 3. Thus, spray down and vacuum functions associated with a conventional wand head and carpet cleaning system generally, are not impeded in any manner by inclusion of attachment 76.

Figure 5A:
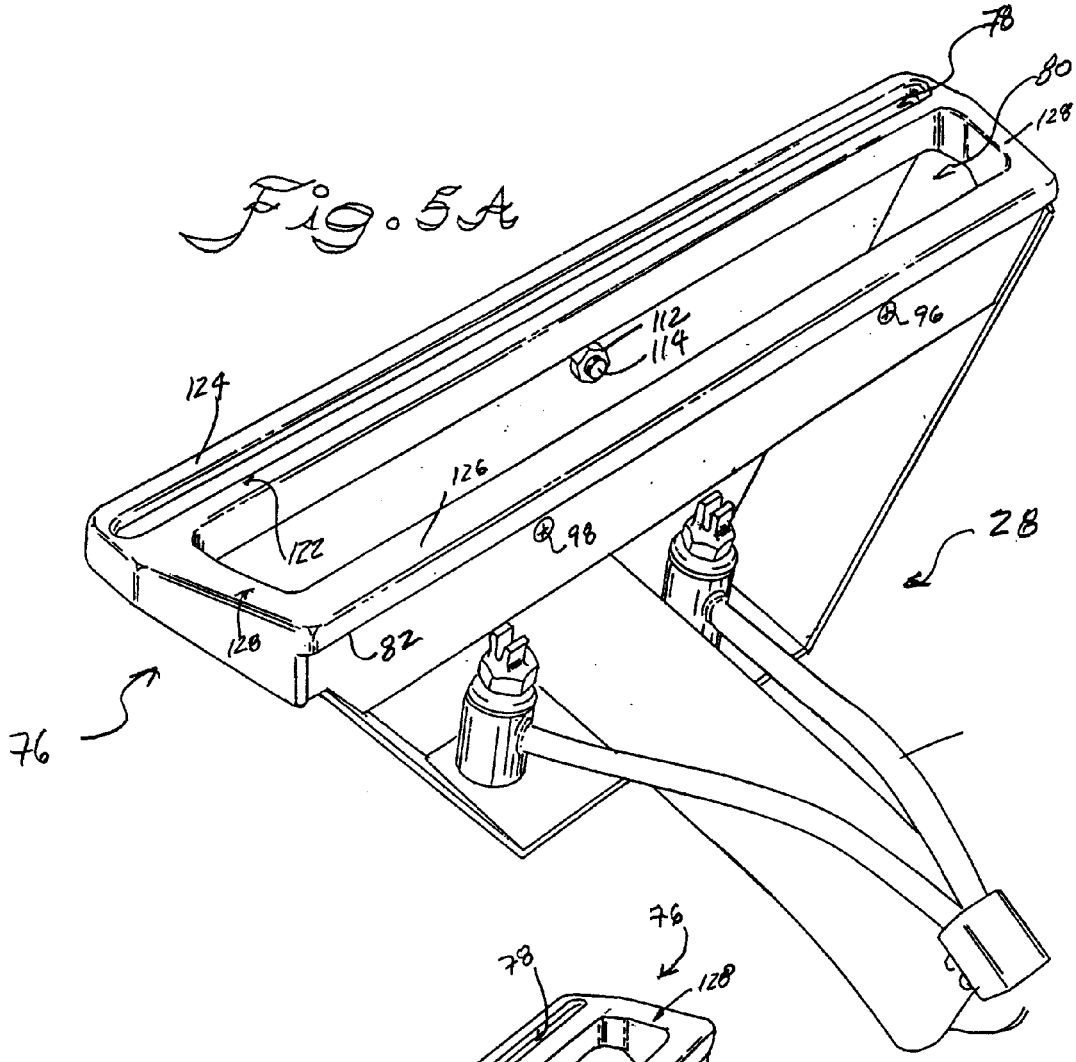
FIG. 5A is a generally bottom perspective view (as in the same view generally as illustrated in FIGS. 3 and 4B), but showing an exemplary embodiment of the subject invention assembled with a conventional carpet cleaning wand head (modified in accordance with the subject invention)
Figure 5B:
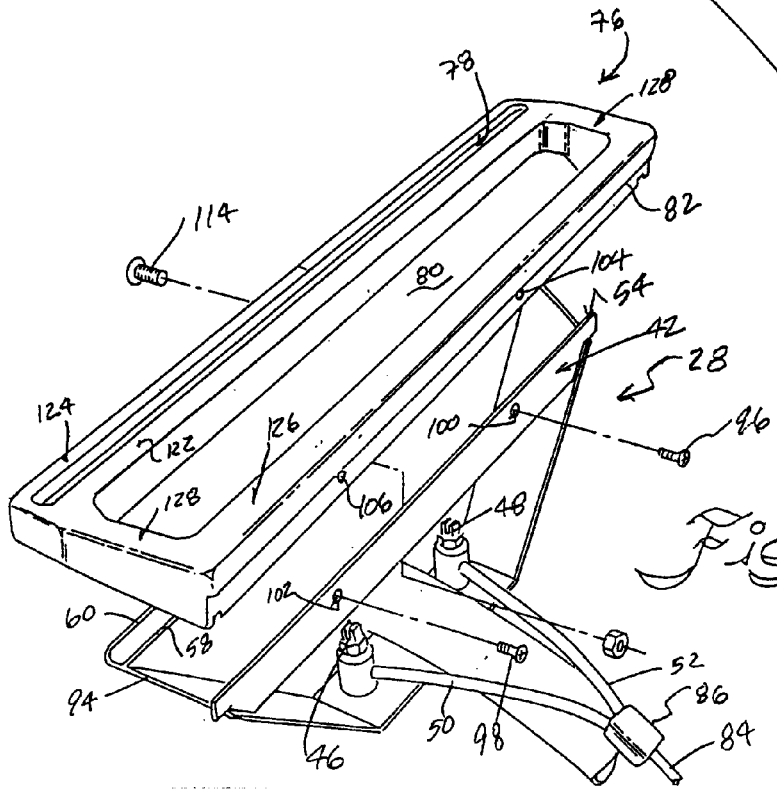
FIG. 5B is an exploded view of the subject matter of FIG. 5A.

FIG. 5A illustrates a bottom perspective view (generally like FIG. 4B) of attachment boot 76, except as also assembled with an exemplary wand head 28 modified for association therewith. FIG. 5B provides a similar perspective view of boot 76 and wand head 28, but in exploded view, with various securement devices or features (such as screws and/or nuts and bolts) removed for illustration purposes.

Figure 6:
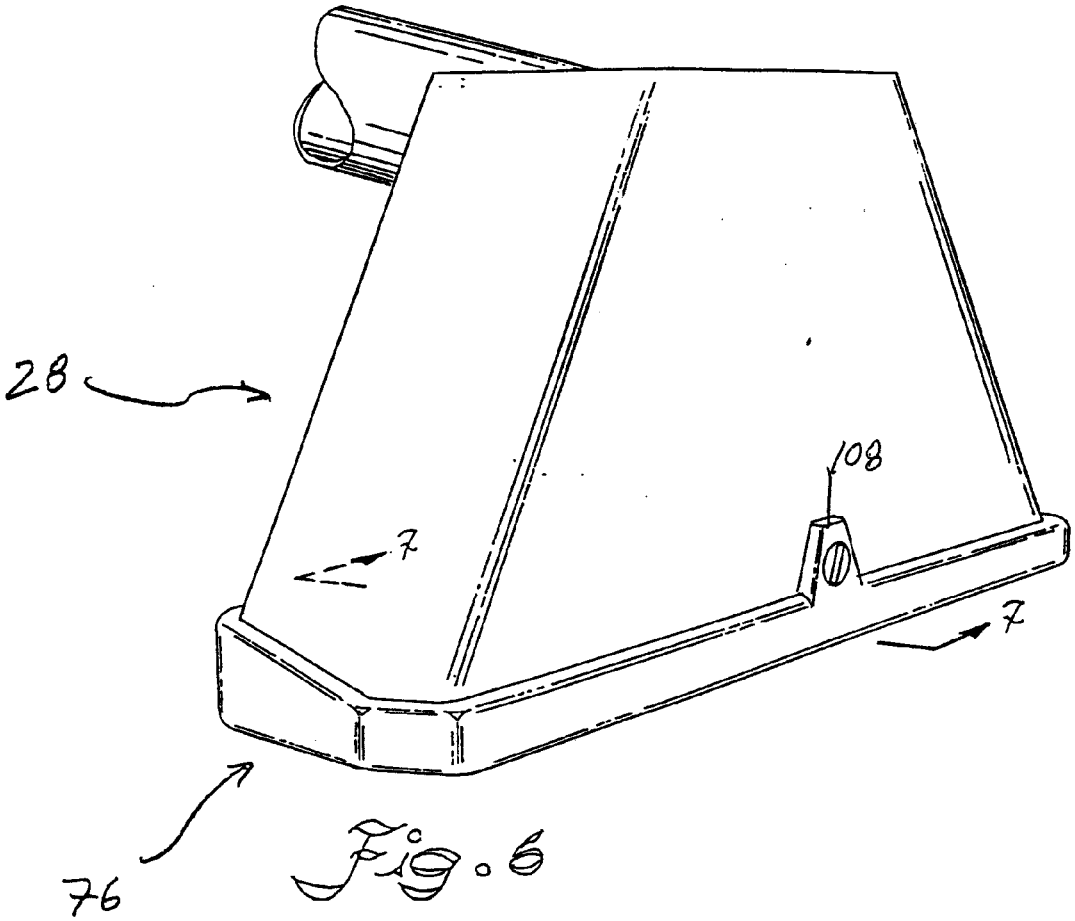
FIG. 6 is an assembled view, as in present FIG. 5A, illustrating an exemplary embodiment of the subject invention, generally in a top perspective view in a position as assumed generally during use thereof.
Figure 7:
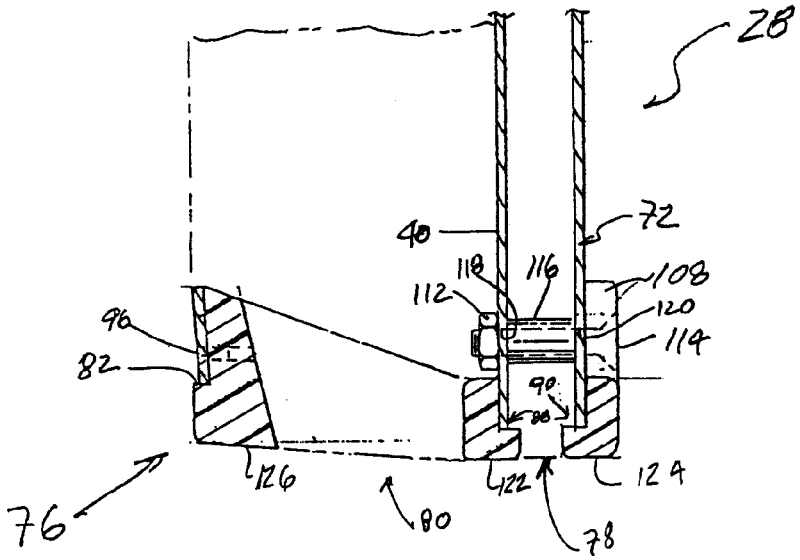
FIG. 7 is a partial cross-sectional view of the features illustrated in present FIG. 6, taken along section line 7—7 as indicated therein.

FIG. 6 illustrates an assembled view of an exemplary attachment boot 76 in accordance with the subject invention and a modified wand head 28, but in a top perspective view thereof, as generally situated during use. FIG. 7 illustrates a cross section of FIG. 6, as taken along section line 7—7 indicated therein.

Collectively FIGS. 4A through 7 illustrate details of the construction and practice of an exemplary attachment boot 76 in accordance with the subject invention, while present FIG. 1 illustrates an overall view of use thereof and of a carpet cleaning system in accordance with the subject invention incorporating the improved features.

In the exemplary embodiment illustrated, attachment boot 76 defines a lip or abutment 82 against which an upper surface 54 of parallel surface member 42 of wand head 28 rests. Reference characters from FIGS. 2 and 3 for wand head 34 illustrated thereof are repeated in other figures of the subject application with reference to wand head 28. They are intended to represent same or analogous features thereof, though wand 28 is otherwise modified as discussed herein for operation with attachment 76. Thus, for the sake of brevity, discussion of such features are incorporated by reference, without complete repetition of such discussion with reference to figures discussing common elements as between wand heads 28 and 34.

The illustration of present FIG. 5B does represent the main liquid feeding hose or line 84 which feeds both separated lines 50 and 52 via a splitter or diverter coupling generally 86. It is main liquid line 84 which may run up the back side of wand 20 (i.e., in a position not seen in FIG. 1), and/or otherwise be passed into vacuum hose 16 for adjoining with mobile unit 12 (or some other unit used in substitution thereof).

As best illustrated by the top perspective view of present FIG. 4A, various channels or slots are formed for receipt of edge surfaces 58 and 60 of wand head 28. Respective channels or slots 88 and 90 dimensionally match respective edge surfaces 58 and 60, for mating therewith. Respective side slots or channels generally 92 likewise capture respective side edge surfaces 94 (only one visible in FIG. 5B) of wand head 28.

As represented in present FIG. 7, the slots or channels 88 and 90 may comprise L-shaped receptors for the respective edges of parallel surface 40 and front surface 72 of wand head 28. In such manner, they remain relatively open, and with minimum construction and weight, for maintaining relatively unimpeded a vacuum area generally 78.

Various devices may be practiced for securing an attachment boot generally 76 to a wand head generally 28 (once modified in accordance with the subject invention). For example, threaded screws and/or bolts and nuts may be practiced, particularly for preferred embodiments, which are readily removable for replacement and/or service. Various interference fits or snap-ons or slide-on arrangements with securing elements may also be practiced. Again, the most preferred embodiments of the subject invention incorporate attachment features which are readily reversed, for ease of removing and servicing (or replacing) the attachment boot 76 and/or wand head 28.

As represented in the present exemplary preferred embodiment, threaded screws generally 96 and 98 may be selectively associated with threaded or non-threaded screwholes 100 and 102, respectively, formed in accordance with the subject invention through surface 42 of wand head 28. Respective screws 96 and 98 are further seated in threaded screwholes 104 and 106 as respectively formed in the illustrated portion of attachment boot 76.

A generally forward or leading edge of attachment boot 76 may likewise be secured (preferably removably) to wand 28. Such an arrangement as illustrated gives a three point attachment support, for sufficient strength and securement with minimum weight.

As represented, attachment boot 76 may be formed with an extension or tab 108, through which a securement opening 110 may also be formed. In such an arrangement, preferably a nut 112 and associated corresponding bolt 114 are utilized together. As represented in present FIG. 7, generally a smooth or jacketed portion 116 may be practiced within vacuum nozzle region 78, to ensure that nothing impedes a desired vacuum flow. Corresponding openings 118 and 120 may be formed respectively in surfaces 40 and 72 of wand 28, for cooperation with nut 112 and bolt 114.

As shown in the illustrated examples, all of the attachment features are readily reversible, to permit attachment boot 76 to be removed. Boot 76 itself may be formed from various materials, preferably such as plastic molded components, to readily achieve the desired shape and low weight characteristics. For example, a black Acetal plastic molded component may be readily fitted in accordance with the subject invention to the cleaning edges of carpet cleaning wand generally 28 and attached thereto at the exemplary three points illustrated (once wand 28 is appropriately modified with the addition of holes 100, 102, 118 and 120). Other types of plastic or other generally lightweight and/or adequately strong components may be practiced.

With the removability feature, once attachment boot 76 is worn (or otherwise damaged, such as through an accident), it may be readily replaced by removing the attachment features as shown, removing the old boot, seating the new boot, and replacing the attachment features, all as will be well understood by those of ordinary skill in the art from the disclosure herewith. Such an arrangement protects the various edge surfaces, such as 54, 58, 60 and 94 of wand head 28 from excessive wear, thereby extending the life of wand head 28 and its associated wand.

FIG. 4B provides an illustration of the expanded surfaces which result from practice of the invention, for elimination of the chatter or skip problem of the prior art as illustrated in present FIG. 2. For example, the relatively narrow edge surfaces 58 and 60 are replaced with broader carpet contact surfaces generally 122 and 124, respectively. While variations may be practiced, resulting dimensions of about one-quarter of an inch in width (the direction along the generally axial arrow 62) is an example of a dimension which provides improvement in accordance with the subject invention.

A "heel" surface generally 126 may be provided for expanding edge surface 54 to a width generally of about one-half inch. Likewise, side surface regions 128 may preferably also be about one-half inch in width (though they appear smaller than surface 126 in present FIG. 4B generally due to the perspective nature of such view).

Still further, in the illustrated exemplary preferred embodiment, the width (along the generally axial arrow 62) of "spray down" area 80 may be about one-half inch wide, so as to generally not impede the spraying function of any associated wand. The width of vacuum nozzle or vacuum return region generally 78 may be about one-quarter of an inch, again without impeding overall vacuum performance of a system 10 into which the subject invention is incorporated to form a new improved carpet cleaning system.

It is to be understood that variations of all such dimensions and arrangements may be practiced, so long as in keeping with the broader principals in accordance with the subject invention. In general, those include providing wider cleaning edges for contact with floor covering surfaces to be cleaned, for smoother draw or other actions or movements with the wand head. With such arrangements, the chatter or skip otherwise associated with conventional wand heads (see FIGS. 2 and 3) may be effectively eliminated. At the same time, the representative attachment boot 76 may be removable for replacement to extend wand life, and may be quickly removed for minimal down time in the field for servicing. In such manner, both a carpet cleaning wand head attachment or boot as provided in accordance with the invention, and an improved carpet cleaning system incorporating such improved wand, are provided.

It should be further understood by those of ordinary skill in the art that the foregoing exemplary preferred embodiments are exemplary only, and that the attendant description thereof is likewise by words of example rather than words of limitation, and their use does not preclude inclusion of such modifications, variations, and/or additions to the present invention as would be readily apparent to one of ordinary skill in the art.

What is claimed is:

1. A carpet cleaning system, comprising:

a base unit providing vacuum pressure and fluid handling;

a vacuum hose having a first end and a second end, wherein said first end is connected to said base unit;

a fluid supply hose having a first supply hose end and a second supply hose end, wherein said first supply hose end is connected to said base unit;

a rigid main body having a first main body end and a second main body end, wherein said first main body end is connected to said second end of said vacuum hose;

a wand head defining a fluid outlet and a vacuum inlet, said wand head connected to said second main body end and said second supply hose end, wherein said fluid outlet and vacuum inlet are defined by edge surfaces of said wand head including a central divider edge surface running the width of said wand head;

a wand head boot defining an interface surface for movement along a surface to be cleaned, said wand head boot connected to said wand head opposite said main body second end, said wand head boot defining a single vacuum inlet opening in fluid communication with said vacuum inlet of said wand head, wherein said wand head boot further comprises channels for receipt of said edge surfaces and said central divider edge surface when connected to said wand head.

2. A carpet cleaning system according to claim 1, wherein said base unit is mobile.

3. A carpet cleaning system according to claim 2, wherein said base unit further comprises rollers.

4. A carpet cleaning system according to claim 1, wherein said rigid main body further comprises a handle portion at the first main body end.

5. A carpet cleaning system according to claim 1, wherein said channels are L-shaped.

6. A carpet cleaning system according to claim 1, wherein said wand head boot further comprises a tab through which a securement opening is formed.

7. A carpet cleaning system according to claim 1, wherein said wand head boot is made of molded plastic.

8. A carpet cleaning system according to claim 7, wherein said wand head boot is made of molded black Acetal plastic.

9. A carpet cleaning system according to claim 1, wherein said interface surface comprises contact surfaces corresponding to each of said edge surfaces and said central divider edge surface and said first and second openings, said contact surfaces being broader than said edge surfaces and said central divider edge surface.

10. A carpet cleaning system as defined in claim 1, wherein said wand head boot defines a fluid outlet opening in fluid communication with said fluid outlet of said wand head.

11. A carpet cleaning system, comprising:

a mobile base unit providing vacuum pressure and fluid handling;

a vacuum hose having a first end and a second end, wherein said first end is connected to said mobile base unit;

a fluid supply hose having a first supply hose end and a second supply hose end, wherein said first supply hose end is connected to said mobile base unit;

a rigid main body having a first main body end and a second main body end, wherein said first main body end is connected to said second end of said vacuum hose;

a wand head connected to said second main body end and said second supply hose end, said wand head defining at least two pathways for transmission of a fluid cleaning material, wherein said wand head further comprises two spray nozzles and two feed hoses, said feed hoses being connected at one end to said second supply hose end through a splitter and being connected at an opposing end to said spray nozzles;

a wand head boot for connection to said wand head opposite said main body second end defining at least two openings, said openings corresponding to said at least two pathways when said wand head boot is connected to said wand head.

12. A carpet cleaning system according to claim 11, wherein said mobile base unit further comprises rollers.

13. A carpet cleaning system according to claim 11, wherein said mobile base unit is a truck-mounted base unit.

14. A carpet cleaning system according to claim 11, wherein said fluid supply hose is connected along its length to said vacuum hose and said main body.

15. A carpet cleaning system according to claim 14, wherein said fluid supply hose is internal to said vacuum hose and said main body.

16. A carpet cleaning system according to claim 11, wherein said rigid main body further comprises a handle portion at the first main body end.

17. A carpet cleaning system according to claim 16, wherein said handle portion is adjustable.

18. A carpet cleaning system according to claim 17, wherein said handle portion includes a trigger for initiating and terminating operation of said system.

19. A carpet cleaning system according to claim 11, wherein said spray nozzles transmit said fluid provided via said fluid supply hose through said splitter and said feed hoses to a surface to be cleaned.

20. A carpet cleaning system according to claim 11, wherein said at least two pathways include a fluid outlet in fluid communication with said nozzles and a vacuum inlet.

21. A carpet cleaning system as defined in claim 11, wherein said wand head boot further comprises a tab, said tab acting as a point of connection with said wand head.

22. A carpet cleaning system according to claim 11, wherein said wand head boot is made of molded plastic.

23. A carpet cleaning system, comprising:

a base unit providing vacuum pressure and fluid handling;

a vacuum hose having a first end and a second end, wherein said first end is connected to said base unit;

a fluid supply hose having a first supply hose end and a second supply hose end, wherein said first supply hose end is connected to said base unit;

a rigid main body having a first main body end and a second main body end, wherein said first main body end is connected to said second end of said vacuum hose;

a wand head defining a fluid outlet and a vacuum inlet, said wand head connected to said second main body end and said second supply hose end;

a wand head boot defining an interface surface for movement along a surface to be cleaned, said wand head boot connected to said wand head opposite said main body second end, wherein said wand head boot further comprises a tab, said tab acting as a point of connection with said wand head.

24. A carpet cleaning system according to claim 23, wherein said wand head boot defines a first opening in fluid communication with said fluid outlet and a second opening in fluid communication with said vacuum inlet of said wand head.

25. A carpet cleaning system according to claim 24, wherein said fluid outlet and vacuum inlet are defined by edge surfaces of said wand head including a central divider edge surface running the width of said wand head.

26. A carpet cleaning system according to claim 25, wherein said wand head boot further comprises channels for receipt of said edge surfaces and said central divider edge surface when connected to said wand head.

27. A carpet cleaning system according to claim 26, wherein said channels are L-shaped.

28. A carpet cleaning system according to claim 23, wherein said wand head boot is made of molded plastic.

29. A carpet cleaning system according to claim 23, wherein said wand head further comprises two spray nozzles and two feed hoses, said feed hoses being connected at one end to said second supply hose end through a splitter and being connected at an opposing end to said spray nozzles.

30. A carpet cleaning system according to claim 29, wherein said spray nozzles transmit said fluid provided via said fluid supply hose through said splitter and said feed hoses to a surface to be cleaned.

* * * * *